United States Patent [19]

Mueller

[11] 4,081,234

[45] Mar. 28, 1978

[54] LIMIT AND CONTROL FOR HEAVY OIL PREHEATING

[75] Inventor: Dale A. Mueller, St. Paul, Minn.

[73] Assignee: Honeywell Inc., Minneapolis, Minn.

[21] Appl. No.: 757,110

[22] Filed: Jan. 5, 1977

[51] Int. Cl.[2] ..... F23H 5/00

[52] U.S. Cl. ..... 431/28; 431/36

[58] Field of Search ..... 431/28, 36, 41

[56] References Cited

U.S. PATENT DOCUMENTS

| | | | |
|---|---|---|---|
| 1,640,729 | 8/1927 | Scott | 431/36 |
| 1,655,852 | 1/1928 | Adams | 236/1 R |
| 3,008,019 | 11/1961 | Scheidig | 200/88 |
| 3,209,099 | 9/1965 | Zearfoss | 200/88 |
| 3,295,081 | 12/1966 | Bowyer et al. | 335/208 |
| 3,649,936 | 3/1972 | Masuda et al. | 335/208 |

FOREIGN PATENT DOCUMENTS

| | | | |
|---|---|---|---|
| 219,750 | 7/1961 | Austria | 431/28 |
| 1,329,822 | 9/1973 | United Kingdom. | |

OTHER PUBLICATIONS

Honeywell — Combination Aquastat and Protectorelay Control — Rev. 11-77, (.028) - Form Number 60-21-44-1, Honeywell, Minneapolis, Minn. 55408.

*Primary Examiner*—Carroll B. Dority, Jr.
*Attorney, Agent, or Firm*—Alfred N. Feldman

[57] ABSTRACT

A control system that provides a safety limit and temperature control for an oil preheater used with oil burners that burn viscous grades of fuel oil. The control incorporates a first temperature sensor for control of a fuel oil heater and a second temperature sensing means to provide for a safe start check of an oil burner. The start is allowed only if the temperature of the oil is at or above the temperature required for proper operation of the fuel burner.

8 Claims, 2 Drawing Figures

LIMIT AND CONTROL FOR HEAVY OIL PREHEATING

BACKGROUND OF THE INVENTION

In recent years, due to the energy supply problem, the use of heavy oils has become more common in the fuel burner industry. In the past, oil preheaters have pretty much been controlled by bimetal operated switches or thermocouples. In the case of thermocouples, the associated control equipment could be remotely located, but was relatively expensive. In the case of bimetal sensed oil preheaters, the bimetal had to be mounted, along with its control circuit at the oil preheater.

SUMMARY OF THE INVENTION

In the present invention, a relatively simple, inexpensive and versatile limit and control for oil preheaters is disclosed. The presently disclosed control can either be located at the oil preheater or can be remotely located, if that type of mounting is desired. The present invention utilizes a bulb and fill type of sensing device for control of the oil preheater itself. The device further utilizes a special type of very small, nonfluid filled, temperature responsive switch means that is operated in a safe start type of circuit to insure a low limit and safe operation of the oil preheater.

In the arrangement where the device is mounted directly on the oil preheater, a housing is provided that attaches directly to a well that is mounted into the oil in the preheater. This well contains a bulb and fill type of sensing element, and the second temperature resonsive switch means which is of a single-pole, double-throw type which operates reliably at a selected temperature. Since the elements that are mounted in the sensing well are limited to two temperature responsive elements, these elements can be provided with convenient extensions in the form of a long capillary for the bulb and fill type switch, and with conventional electric circuitry, normally of the low voltage type, for the second temperature sensing element. With this arrangement it is possible to remotely mount the control housing from the well, thereby adding great flexibility and reduction in cost in application of the present invention to different types of fuel oil burner control systems.

DESCRIPTION OF THE PREFERRED EMBODIMENT

Figures 1, 2:
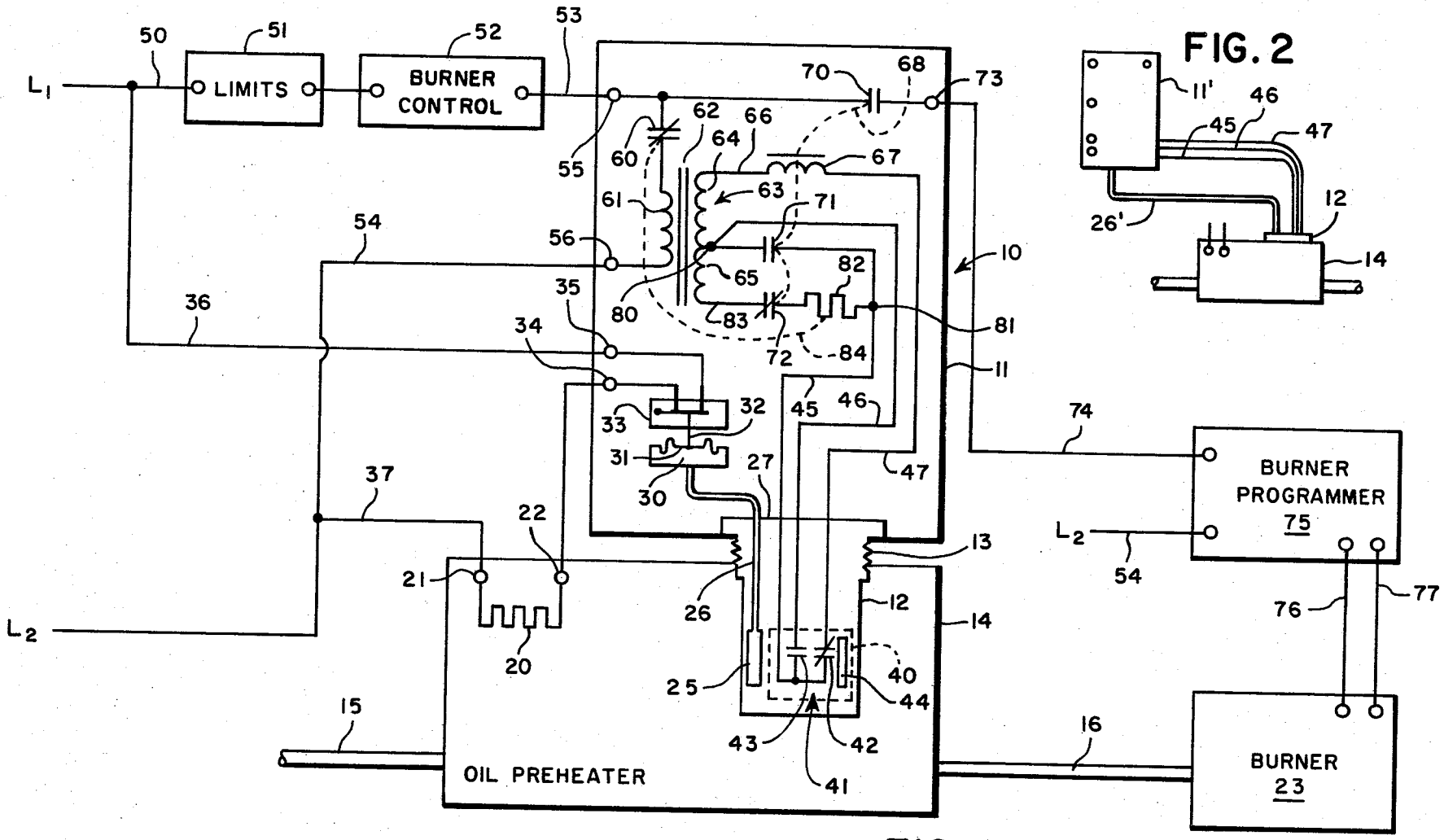
FIG. 1 is a schematic representation of a complete limit and control for heavy oil preheating when adapted for use in an oil burner system.
FIG. 2 is a representation of the control when mounted remote from the oil preheater itself.

A limit and control for heavy oil preheating is generally disclosed at 10 and includes a housing or enclosure 11 and a fluid tight well 12. In FIG. 1, the well 12 and the housing 11 are shown as an integral unit. The well 12 has a threaded portion 13 that allows it to be threaded into a tank 14 which has an oil inlet 15 and an oil outlet 16. The tank 14 is an oil preheater and contains a volume of heavy fuel oil that is to be heated to reduce its viscosity so that the oil can be utilized. The tank 14 further contains an electric heater 20 that is connected to a pair of terminals 21 and 22. The heater 20 could be any type of electrically controlled heater means. Oil is supplied via the pipe 15 to the tank 14 and is fed out of the pipe 16 to a fuel burner generally disclosed at 23. The fuel burner 23 is not part of the present invention, nor is the oil preheater enclosed in tank 14 except for the content of the well 12.

Contained in the well 12 is a bulb 25 and a capillary element 26 that feed out of the top 27 of the well 12 to a diaphragm sealed chamber 30 that is fluid tight and has a diaphragm 31 that varies in position as the fluid fill in the capillary 26 and bulb 25 change in volume with changes in temperature. This type of temperature sensing element is well known in the art and can have a capillary element 26 of any convenient length. The diaphragm 31 operates through a lever 32 to operate a switch means 33 that normally would be a snap switch. The switch means 33 is connected to a pair of terminals 34 and 35. The terminal 34 is connected to terminal 22 of the oil heater 20 while the terminal 35 is connected to a conductor 36 that is connected back to a source of power disclosed as L1 and L2. The circuit for supplying electrical energy to the heater 20 is completed by terminal 21 being connected by conductor 37 to the source connection L2. It is thus seen that whenever the switch means 33 closes, that the heater 20 is supplied with the electrical energy to heat the oil contained in the tank 14.

Also contained in the well 12 is a second temperature responsive means 40 that includes a temperature responsive switch means generally disclosed at 41 and includes a close switch contact 42 and an open switch contact 43 whenever the oil to be heated is at or above the desired temperature. The switch means 41 is a single-pole, double-throw switch mechanism and is activated by a magnetic member 44. It is preferably snap acting. The magnetic member 44 is a Curie point type of material and magnetic to operate the switch means 41. This type of switch is known in the art as a thermoferrite reed switch and is capable of operation in a relatively sharp manner at a predetermined temperature. The second temperature responsive switch means 40 can be of any electrical type, but is preferably of the thermoferrite reed switch type schematically represented.

The switch elements 42 and 43 are connected to three conductors 45, 46 and 47. The conductor 45 is common to the switch elements 43 and 42, while the conductor 46 connects to the switch element 43 and the conductor 47 connects to the switch element 42. The conductors 45, 46 and 47 can be of any convenient length and in the disclosure of FIG. 1 are quite short since the well 12 is mounted integrally with the housing or enclosure 11 to form the limit and control device 10.

The voltage source for the present device has been indicated as lines L1 and L2, and the L1 conductor is connected by a lead 50 to any convenient type of safety limit 51 that is normal in an oil burner control system. The limit in turn is connected to a burner control device 52 that can be a manual switch, thermostat or similar type of device. The burner control device 52 provides a voltage on conductor 53 whenever the limits 51 and the burner control 52 are closed. Energy is also supplied on conductor 54 from the line terminal L2 and thus the line voltage is supplied at a pair of terminals 55 and 56 for the limit and control device 10.

The terminal 55 is connected to a normally closed safety switch means 60 that completes a circuit to a transformer primary winding 61 of a step-down transformer 62. While the present device discloses a step-down transformer 62, the transformer could be of any type as long as the primary winding 61 is provided along with a tapped winding generally disclosed at 63. If it is assumed that the transformer 62 is a step-down type the tapped winding 63 has two separate winding portions 64 and 65 of a relatively low voltage. The upper end of the tapped winding 64 is connected by a conductor 66 to a relay coil 67 that is magnetically coupled as shown at 68 to two normally open contacts 70 and 71, along with a normally closed contact 72. It will be noted that the normally open contact 70 is connected to the terminal 55 to receive the line voltage L1 and in turn is connected to a further terminal 73 so that the line L1 can be supplied on conductor 74 to a burner programmer generally disclosed at 75 of any convenient type. The line voltage L2 is again disclosed and would be part of conductor 54 to supply the balance of the electrical energy to the burner programmer 75. The burner programmer 75 is disclosed schematically as having a pair of conductors 76 and 77 that control the burner 23. This portion of the circuitry can be varied extensively depending on the type of burner programmer 75 used and the type of burner 23 that is operated.

The limit and control device is again considered and it is noted that the conductor 47 connects to the relay coil 67. The conductor 46 is connected to a tap on the transformer at 80 and the conductor 45 is connected to a junction 81 between the safety switch heater 82 and the normally opened relay contact 71. The electric circuitry is completed by a conductor 83 that connects one end of the tapped winding 63 to the normally closed contact 72 that in thurn is connected to the safety switch heater 82. It will be noted, by the dash linee 84, that the safety switch heater 82 is coupled to the safety switch 60. This is a conventional type of safety switch wherein the switch contacts 60 are of the trip-free type and are mechanically latched closed until the safety switch heater 82 has been heated by current passing through it for a sufficiently long period of time at which time the switch 60 opens. Once the switch 60 opens, it requires manual reset in order to close the contact 60 to the condition shown.

OPERATION OF FIG. 1

The operation of FIG. 1 is described with the system considered to be at a proper operating temperature with the limits 51 and burner control 52 closed along with the snap switch 33 being closed to supply energy to the heater 20 under the influence of the bulb and capillary 25 and 26. The thermoferrite switch or means 40 is in the position shown with the contact 43 open and the contact 42 closed as long as the temperature of the oil in tank 14 is at or above a temperature to maintain a sufficiently low viscosity of the oil to be supplied to the burner 23. Under these conditions, the primary winding 61 is supplied with electrical energy so that the secondary winding 63 is also energized. An initial energizing circuit is then completed through the relay coil 67, conductor 47, the closed switch 42, the common conductor 45 and the safety switch heater 82 along with the normally closed relay contact 72. This complete circuit provides the necessary energizing current for the relay coil 67 and the relay immediately pulls in. This closes the contact 70 to supply the burner programmer 75 and the burner 23 with electrical energy for proper operation.

At the time that relay coil 67 is energized and contact 70 closes, contact 71 also closes thereby providing a hold-in path for relay coil 67 through closed switch 42 and opening the normally closed contact 72 to remove voltage from safety switch heater 82. Contact 71 closes before contact 72 opens. This arrangement provides for a check of the continuity of the safety switch heater 82 as a pull in portion of the circuit for the relay 67. To this point, the normal operation of the device has been disclosed.

In the event that the oil heater 20 fails to keep the temperature of the oil at a sufficiently high temperature for proper operation of the burner 23, the thermoferrite switch means 40 is caused to operate with the switch 42 opening and the contact 43 closing. The opening of the contact 42 causes an open circuit to the relay coil 67 and the relay drops out immediately and the contacts 70, 71 and 72 move to the position shown in FIG. 1. At this same time the contact 43 is closed and provides a circuit between the tap 80, through the closed contact 43 to the junction 81, through the safety switch heater 82, and through contact 72, so that the safety switch heater is then continuously heated by the voltage appearing across the portion 65 of the secondary winding 63. The continuous flow of current heats the heating element 82 and eventually opens the safety switch 60. This removes power from the unit so that the burner programmer 75 and burner 23 can no longer receive power, and requires manual reset of the safety switch 60 prior to reestablishement of operation of the device. This, therefore, calls the attention to service personnel that the oil preheater in tank 14 is not functioning properly and this type of malfunction can be corrected.

The circuit disclosed is a safe start check arrangement and allows for the monitoring the oil temperature to provide for safe operation of a burner 23. In FIG. 2 there is disclosed an arrangement wherein the limit and control device 10 of FIG. 1 has been broken into the housing or enclosure 11' and the well 12 as mounted in the tank 14. In this case the conductors 45, 46 and 47 are sufficiently long to reach between the well 12 and the enclosure 11'. In this case the capillary 26' has been provided that is of sufficient length to provide the separation between the well 12 and the enclosure 11'. This arrangement allows for the remote mounting of the housing 11' which encloses the limit and control device. This adds great flexibility in the adaptation and mounting of the entire device in a burner control system.

The present invention provides for a very simple system to install and one which is very competitive from a cost standpoint. The exact types of switches utilized in the well 12 can vary and a preferred type of switch has been described. The variance from one type of temperature responsive switch to another can be made by those skilled in the art. The scope of the present invention is therefore, limited solely by the scope of the appending claims.

The embodiments of the invention in which an exclusive property or right is claimed are defined as follows.

1. A limit and control for heavy oil preheating adapted for use with an oil burner system, including: oil temperature sensing means including first temperature responsive switch means adapted to operate an oil heater used to preheat heavy fuel oil to maintain a sufficiently low viscosity to properly utilize the fuel oil; said oil temperature sensing means further having second temperature responsive switch means including a single-pole, double-throw switch; transformer means including a primary winding adapted to be connected to a source of power, and a tapped, secondary winding; said tapped secondary winding connected to a first circuit including a relay, a portion of said second switch means which is closed when said fuel oil is at or above a predetermined temperature, a safety switch heater, and a normally closed relay contact; said safety switch heater being coupled to safety switch contact means to open circuit said transformer means upon said safety switch heater being energized for a predetermined period of time; said tapped secondary winding further connected to complete latching circuit means including a normally open relay contact, said safety switch heater, and said normally closed relay contact to provide a latching action for said relay upon said relay being energized through said safety switch heater; said normally open relay contact being connected in parallel circuit with a portion of said second switch means that is open circuited upon said fuel oil being at or above said predetermined temperature; and a further normally open relay contact which closes upon operation of said relay and is adapted to connect said source of power to said oil burner system to cause said system to be operative.

2. A limit and control for heavy oil preheating as described in claim 1 wherein said tapped secondary winding is a low voltage secondary winding.

3. A limit and control for heavy oil preheating as described in claim 2 wherein said second temperature responsive switch means is thermoferrite switch means.

4. A limit and control for heavy oil preheating as described in claim 3 wherein said safety switch contact means includes mechanical latch means to provide for manual reset of said safety switch contact means after operation thereof; and said safety switch contact means is in a series circuit with said transformer primary winding.

5. A limit and control for heavy oil preheating as described in claim 4 wherein both of said temperature responsive switch means are located adjacent each other in an oil tight well.

6. A limit and control for heavy oil preheating as described in claim 5 wherein said first temperature responsive switch means includes a fluid filled system having a diaphragm operated snap switch.

7. A limit and control for heavy oil preheating as described in claim 6 wherein said well is mounted integrally with a housing that forms an enclosure for the limit and control elements.

8. A limit and control for heavy oil preheating as described in claim 6 wherein said well is mounted remote from a housing that forms an enclosure for the limit and control elements.

* * * * *